US012326300B2

(12) United States Patent
Leonard

(10) Patent No.: US 12,326,300 B2
(45) Date of Patent: Jun. 10, 2025

(54) RECUPERATIVE TEMPERATURE REGULATION FOR GAS DRYERS IN EXTREME TEMPERATURE ENVIRONMENT

(71) Applicant: Qnergy Inc., Ogden, UT (US)

(72) Inventor: David Leonard, North Ogden, UT (US)

(73) Assignee: Qnergy Inc., Ogden, UT (US)

( * ) Notice: Subject to any disclaimer, the term of this patent is extended or adjusted under 35 U.S.C. 154(b) by 30 days.

(21) Appl. No.: 18/456,538

(22) Filed: Aug. 28, 2023

(65) Prior Publication Data

US 2024/0167770 A1 May 23, 2024

Related U.S. Application Data

(60) Provisional application No. 63/384,629, filed on Nov. 22, 2022.

(51) Int. Cl.
*F28D 20/00* (2006.01)
*F28F 17/00* (2006.01)

(52) U.S. Cl.
CPC ..... *F28D 20/00* (2013.01); *F28F 17/005* (2013.01); *F28D 2020/0069* (2013.01); *F28F 2250/08* (2013.01)

(58) Field of Classification Search
None
See application file for complete search history.

(56) References Cited

U.S. PATENT DOCUMENTS

2008/0302327 A1* 12/2008 Dahl ..... F02B 29/0468 123/184.53
2010/0139306 A1* 6/2010 Krenik ..... F25B 9/004 62/402
2018/0031275 A1* 2/2018 Wilson ..... F24F 11/63
2024/0167770 A1* 5/2024 Leonard ..... F28D 20/00

FOREIGN PATENT DOCUMENTS

EP 0308532 A1 * 3/1989
GB 2082751 A * 3/1982
GB 2555447 A * 5/2018
RU 177549 U1 * 2/2018

OTHER PUBLICATIONS

RU-177549-U1 English Machine Translation (Year: 1989).*
EP-0308532-A1 English Machine Translation (Year: 2018).*

* cited by examiner

*Primary Examiner* — Jenna M Maroney
(74) *Attorney, Agent, or Firm* — Dekel Patent Ltd.; David Klein

(57) ABSTRACT

A system includes a heat exchanger that includes a relatively hotter process gas inlet and an exit port, a moisture removing filter coupled to the exit port, the moisture removing filter including a relatively colder gas exit, and a drain valve coupled to the moisture removing filter. The heat exchanger, the moisture removing filter, and the drain valve are all located in a thermally-insulated enclosure. A fan is placed outside the thermally-insulated enclosure and forces ambient air over the heat exchanger. The ambient air is sufficient to maintain a temperature above a water freezing temperature in the thermally-insulated enclosure even if the ambient air is below the water freezing temperature.

10 Claims, 1 Drawing Sheet

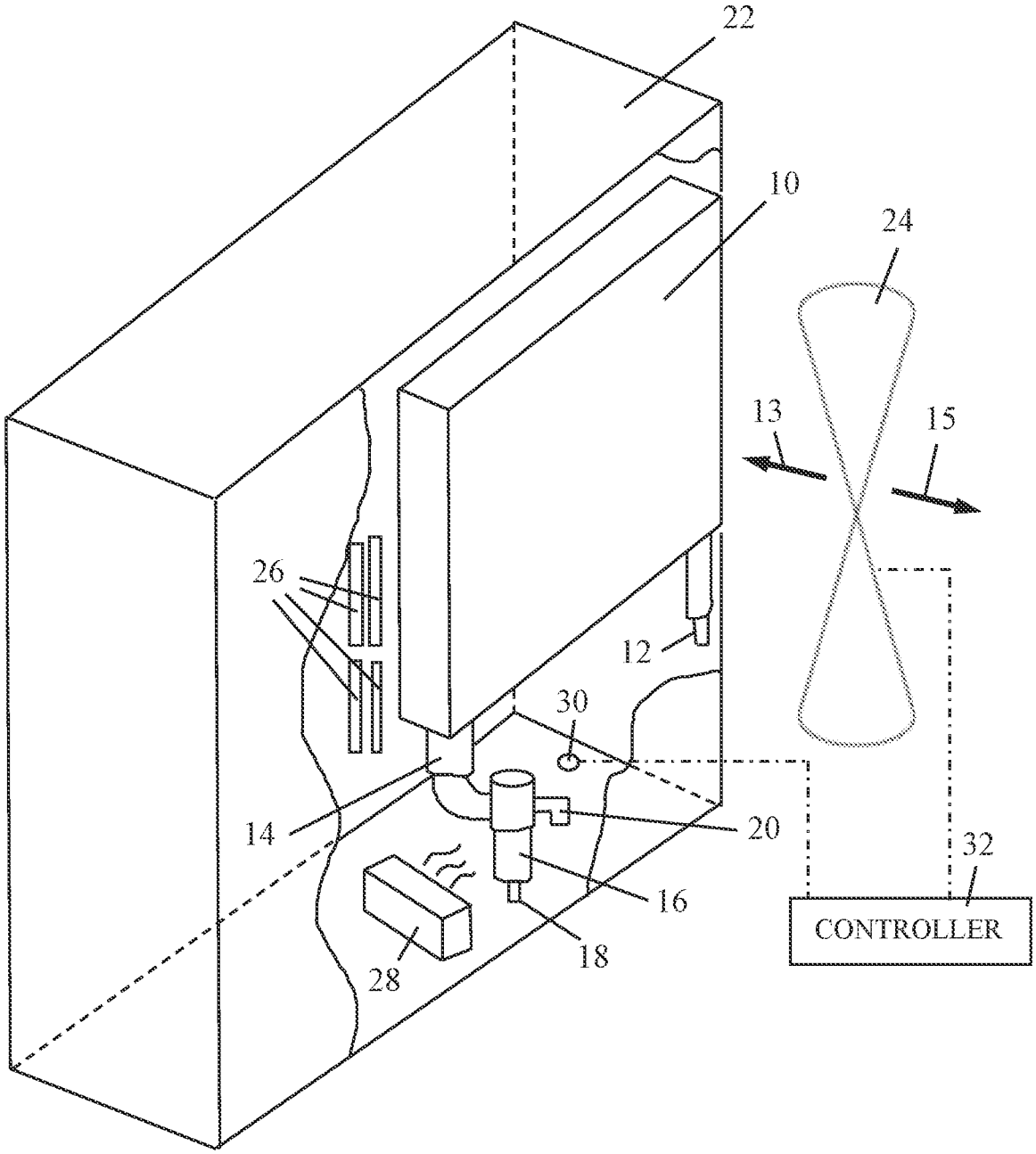
22
10
24
13
15
26
12
30
14
20
32
16
CONTROLLER
18
28

RECUPERATIVE TEMPERATURE REGULATION FOR GAS DRYERS IN EXTREME TEMPERATURE ENVIRONMENT

FIELD OF THE INVENTION

The present invention relates to gas compression systems, and particularly to a system and method for recuperatively reusing recovered heat from a gas compression system to warm up devices sensitive to condensate freezing temperatures in cold ambient environments.

BACKGROUND OF THE INVENTION

Compressed gasses are a common medium used to store and transfer energy from a central source to multiple points of use. The ambient conditions at the central source and the multiple points of use can vary, which affects the properties of the compressed gas. One example is the effects of temperature on the water saturation point. Air and other gasses, such as some biogas, contain water and also other condensable media, each at a certain volumetric concentration in the form of vapors. In certain temperature and pressure conditions, the vapors may condense and form liquids which might even freeze to form solids. Condensable liquids within the compressed gas can have detrimental consequences on the devices converting the mechanical work as well as ON transmission lines, such as causing corrosion problems or forming frozen solids within valve orifices that prevent operation of the valve.

Accordingly, it is desirable to remove as much water or any other condensate content as possible from compressed gas before exposing it to conditions that can cause formation of liquids or solids, such as in low temperature environments. Condensates that forms within devices such as drip pots, coalescing and desiccant filters or transmission piping needs to remain above the freezing temperature to ensure no blockage and no loss of functionality. This typically requires a controlled heat source that is costly to operate.

SUMMARY

The present invention seeks to provide a system and method for recuperatively reusing recovered heat from a gas compression system to warm up devices sensitive to condensate freezing temperatures in cold ambient environments.

The invention may be used to manage the temperature of devices such as drip pots, desiccant and coalescing filters and all transmission piping while reducing the energy required to maintain these temperatures for safe and continuous operation of the devices. This invention may be particularly useful in harsh ambient conditions, such as ambient temperatures down to, or even below −40° F. (−40° C.), where energy is costly and hard to come by.

BRIEF DESCRIPTION OF DRAWINGS

The present invention will be understood and appreciated more fully from the following detailed description, taken in conjunction with the drawings in which:

FIG. 1 is a schematic illustration of system and method for recuperatively reusing recovered heat from a gas compression system, in accordance with a non-limiting embodiment of the present invention.

DETAILED DESCRIPTION

Reference is now made to FIG. 1. The system of the invention may include a heat exchanger 10, also referred to as an aftercooler 10. The aftercooler 10 includes a hot compressed gas inlet 12 into which hot compressed gas may be introduced. The heat exchanger 10 may be of any kind of heat exchanger, such as but not limited to, plate fins, corrugated fins, pin fins, spiral finned tubes and many more.

After traveling through heat exchanger 10, the cooled gas may exit at an exit port 14 to a coalescing and/or desiccant filter 16 (also referred to as a moisture removing filter 16). The moisture removing filter 16 may remove most of the liquid moisture and solids from the compressed gas. A drain valve 18 may be coupled to moisture removing filter 16 for draining liquid that has accumulated in the system. The moisture removing filter 16 may have a cold gas exit 20, from which cold gas exits for use by the end user.

It is noted that gas compressors typically compress the media in a rapid manner, so that the compression is basically adiabatic; the compression is done so fast that the heat is mostly unable to be released and thus the gas temperature rises. This hot compressed gas is what is cooled by heat exchanger 10, and much of the vapor content in the hot compressed gas condenses.

In accordance with a non-limiting embodiment of the present invention, the heat exchanger 10, moisture removing filter 16, and drain valve 18 are all located in a thermally-insulated enclosure 22. A fan 24 is placed outside thermally-insulated enclosure 22 and forces ambient air (ambient being defined as external to the thermally-insulated enclosure 22) over heat exchanger 10. The cooler ambient air removes heat from the compressed process gas. Fan 24 may be controlled so as to drive enough air to maintain the gas and condensate temperature above freezing in the thermally-insulated enclosure 22 even if the ambient air is far below freezing.

Since heat exchanger 10, along with all the other devices used to remove condensates such as moisture removing filter 16 and drain valve 18, are all placed within thermally-insulated enclosure 22, a uniform temperature above freezing point can be maintained within thermally-insulated enclosure 22. The heat exchanger 10 may be mounted on the inner face of one of the walls of thermally-insulated enclosure 22 so that the inlet or outlet of heat exchanger 10 is facing the inside of thermally-insulated enclosure 22 and the opposite side is facing the outside of thermally-insulated enclosure 22. Accordingly, fan 24 can either push ambient air into thermally-insulated enclosure 22 (in the direction of arrow 13) or pull ambient air (in the direction of arrow 15). A vent 26 is provided in one of the walls of thermally-insulated enclosure 22 to allow for the air to exit or enter depending on the flow direction. The speed of the fan can be controlled to regulate flow to maintain a desired temperature within the thermally-insulated enclosure 22.

A heater 28, such as but not limited to, a small electric heater, may be provided in the enclosure 22 to further heat any of the components, such as filter 16 or drain valve 18. A solenoid coil used to operate the drain valve can be energized to provide heat. The solenoid coil is considered another example of heater 28. For example, freezing water at drain valve 18 can cause the valve orifice to be plugged up and thus hinder the extraction of the collected condensate. Energizing the solenoid coil causes the valve body to heat up and eliminate the formation of ice.

The fan 24 may be in operative communication with a temperature sensor 30 and a controller 32. The temperature sensor 30 may be a thermistor, thermocouple or any other type of sensor. The controller 32 can modify operation of fan 24 in accordance with a temperature of thermally-insulated enclosure 22 as sensed by temperature sensor 30 to maintain a desired temperature of thermally-insulated enclosure 22.

Likewise a thermostat or other thermal switch can be used to operate the fan directly by turning it off and on to maintain temperature. The thermostat is considered an example of controller 32.

Placement of heat exchanger 10, along with all the other devices used to remove Condensates such as moisture removing filter 16 and drain valve 18, within thermally-insulated enclosure 22, prevents accumulation of humidity condensation and prevents freezing of critical components.

The invention claimed is:

1. A system comprising:

a heat exchanger that comprises a hot compressed gas inlet and an exit port;

a moisture removing filter coupled to said exit port, said moisture removing filter comprising a cold gas exit;

a drain valve coupled to said moisture removing filter;

wherein said heat exchanger, said moisture removing filter, and said drain valve are all located in a thermally-insulated enclosure; and a fan placed outside said thermally-insulated enclosure which is configured to force ambient air over said heat exchanger, said ambient air being sufficient to maintain a temperature above a condensate freezing temperature in said thermally-insulated enclosure even if the ambient air is below the condensate freezing temperature.

2. The system according to claim 1, wherein said heat exchanger is mounted on an inner face of a wall of said thermally-insulated enclosure so that one side of said heat exchanger faces inwards of said thermally-insulated enclosure and an opposite side of said heat exchanger faces outwards of said thermally-insulated enclosure.

3. The system according to claim 1, wherein said fan pushes the ambient air into said thermally-insulated enclosure.

4. The system according to claim 1, wherein said fan pulls the ambient air into said thermally-insulated enclosure.

5. The system according to claim 1, wherein said thermally-insulated enclosure comprises a vent.

6. The system according to claim 1, wherein said thermally-insulated enclosure comprises a heater for heating components inside said thermally-insulated enclosure.

7. The system according to claim 1, wherein said fan is in operative communication with a temperature sensor and a controller, wherein said controller is configured to modify operation of said fan in accordance with a temperature of said thermally-insulated enclosure as sensed by said temperature sensor.

8. The system according to claim 1, wherein said fan is operated by a thermal switch located within the thermally-insulated enclosure.

9. The system according to claim 1, wherein said drain valve is operated by a solenoid coil energized so as to provide heat to the drain valve and negate any formation of ice at the drain valve.

10. A method for operating a gas compression system comprising:

providing a heat exchanger that comprises a hot compressed gas inlet and an exit port;

providing a moisture removing filter coupled to said exit port, said moisture removing filter comprising a cold gas exit;

providing a drain valve coupled to said moisture removing filter;

wherein said heat exchanger, said moisture removing filter, and said drain valve are all located in a thermally-insulated enclosure; and placing a fan outside said thermally-insulated enclosure so that said fan forces ambient air over said heat exchanger, said ambient air being sufficient to maintain a temperature above a condensate freezing temperature in said thermally-insulated enclosure even if the ambient air is below the condensate freezing temperature.

* * * * *